US005363516A

United States Patent [19]

Butts

[11] Patent Number: 5,363,516

[45] Date of Patent: Nov. 15, 1994

[54] TOILET TRAINING DEVICE FOR CHILDREN

[76] Inventor: Becky Butts, 125 McGaughey Dr., Mt. Zion, Ill. 62549

[21] Appl. No.: 131,187

[22] Filed: Oct. 4, 1993

[51] Int. Cl.[5] ..... A47K 11/04

[52] U.S. Cl. ..... 4/661; 434/247; 4/483

[58] Field of Search ..... 4/300.3, 661, 581, 479, 4/483; 434/247; 374/162; 116/67

[56] References Cited

U.S. PATENT DOCUMENTS

| | | | |
|---|---|---|---|
| 2,776,438 | 1/1957 | Zeraffa | 4/483 |
| 3,020,528 | 2/1962 | Swanson, Jr. et al. | 340/235 |
| 3,861,213 | 1/1975 | Parker | 73/356 |
| 3,898,354 | 8/1975 | Parker | 427/256 |
| 3,965,742 | 6/1976 | Parker | 73/356 |
| 4,019,368 | 4/1977 | Navato | 73/356 |
| 4,044,405 | 8/1977 | Kreiss | 4/661 |
| 4,459,046 | 7/1984 | Spirg | 374/162 |
| 4,744,113 | 5/1988 | Kogut | 4/661 |
| 5,094,545 | 3/1992 | Larsson et al. | 374/162 X |
| 5,117,515 | 6/1992 | White, Jr. et al. | 4/661 |
| 5,282,683 | 2/1994 | Brett | 374/162 X |
| 5,285,540 | 2/1994 | Putz | 4/661 |

FOREIGN PATENT DOCUMENTS

| | | | |
|---|---|---|---|
| 0026236 | 2/1983 | Japan | 374/162 |
| 2108838 | 5/1983 | United Kingdom | 4/581 |

*Primary Examiner*—Robert M. Fetsuga
*Attorney, Agent, or Firm*—Shlesinger, Arkwright & Garvey

[57] ABSTRACT

A toilet training device for children comprising a receptacle for receiving urine from a child, thermally actuated latent image element positioned in the receptacle, the receptacle having an open top for viewing the thermally actuated latent image element whereby urine received within the receptacle actuates the element causing the latent image to appear and be seen by the child thereby encouraging use of the toilet.

9 Claims, 2 Drawing Sheets

TOILET TRAINING DEVICE FOR CHILDREN

FIELD OF THE INVENTION

The present invention relates to training aids and more particularly to a toilet training device for instructing infants and young children on how to properly use a toilet.

BACKGROUND OF THE INVENTION

During early childhood development, parents often begin instruction of their child on the use of a toilet to relieve themselves. This period is often referred to as "toilet training" and during this time the child is encouraged to use the toilet rather than persist in relying upon diapers or the like. As is readily apparent, it is highly desirable to reduce the amount of time it takes to instruct small children on the proper use of a toilet. However, such instruction requires patience and perseverance on the part of the parent since children are highly individual on how they will react to the training.

As a result, a variety of devices have been developed to encourage children to use a toilet during the toilet training period. Whether dealing with male or female children, a device that makes urination into the toilet enjoyable for the child is desirable. It is believed that attracting the child's attention to the toilet will encourage urination therein and therefore alleviate or avoid the stress normally encountered during the training period.

A variety of prior art device exists to assist in toilet training young children. For example, visible targets have been placed within the toilet or affixed to the open face of the toilet. Still other devices have included thin paper stock elements with indicia or other configurations that float on the surface of the toilet water and attract attention. Yet another device includes an electrical circuit means that emits music, buzzers or the like upon successful use of the toilet.

Each of these prior art devices are either too complicated, expensive to manufacture, difficult to clean or non-reusable. Further, prior art devices positionable over the open face of the toilet tend to deflect the urine and cause splashing which is counterproductive to the training.

A need has therefore existed within the art for a toilet training device that attracts the attention of the child and encourages use of the toilet in a proper manner while reducing the toilet training time period and at the same time is of relatively low cost and reusable.

OBJECTS AND SUMMARY OF THE INVENTION

The present invention relates to a toilet training device for children comprising a receptacle means for receiving urine from a child, thermally actuated latent image element positioned in the receptacle, the receptacle means having means for viewing the thermally actuated latent image element whereby urine received by the receptacle actuates the element causing a latent image to appear and be seen by the child thereby encouraging use of the toilet.

It is therefore an object of the present invention to provide a toilet training device for children which will encourage the child to use the toilet thereby alleviating the extreme difficulty associated with the training period.

An additional object of the present invention is to provide a toilet training device for children which will readily attract the attention of the child as he or she is urinating thereby reinforcing the child with positive thoughts during the training period.

Yet another object of the present invention is to provide a toilet training device which is readily cleaned after use and is reusable thereby eliminating excessive waste.

A still further object of the present invention is to provide a toilet training device which is neither obtrusive nor complicated and which is readily adaptable to a conventional child's toilet.

Yet another object of the present invention is to provide a toilet training device which will reduce the tendency for splashing of the urine during use.

Still a further object of the present invention is to provide a toilet training device which causes an identifiable indicia or symbol such as teddy bears, dogs, fish or the like to surprisingly appear once the child urinates properly and without requiring special agility on the part of the child.

Still a further object of the present invention is to provide a toilet training device which can be quickly cleaned and reused for subsequent toilet training sessions.

Still a further object of the present invention is to provide a toilet training device which creates a highly recognizable image that is visually clear and readily apparent to the child and which does not require complicated attachment or disposition of the device to the toilet.

A further object of the present invention is to provide a toilet training device for children which is economical to manufacture.

A further object of the present invention is to provide a toilet training device that is hygienic and easily cleaned because of the relatively smooth, seamless one-piece receptacle construction.

A still further object of the present invention is to provide a toilet training device which is non-toxic, non-electrical and therefore safe.

A still further object of the present invention is to provide a toilet training device which because it is safe, encourages the child to explore and play with the device and therefore alleviates nervousness.

Another object of the present invention is to provide a toilet training device which is disposable if so desired.

These and other objects of the present invention will become apparent from the detailed description below taken into conjunction with the drawings and the claims.

DETAILED DESCRIPTION OF THE PREFERRED EMBODIMENT

Figure 1:
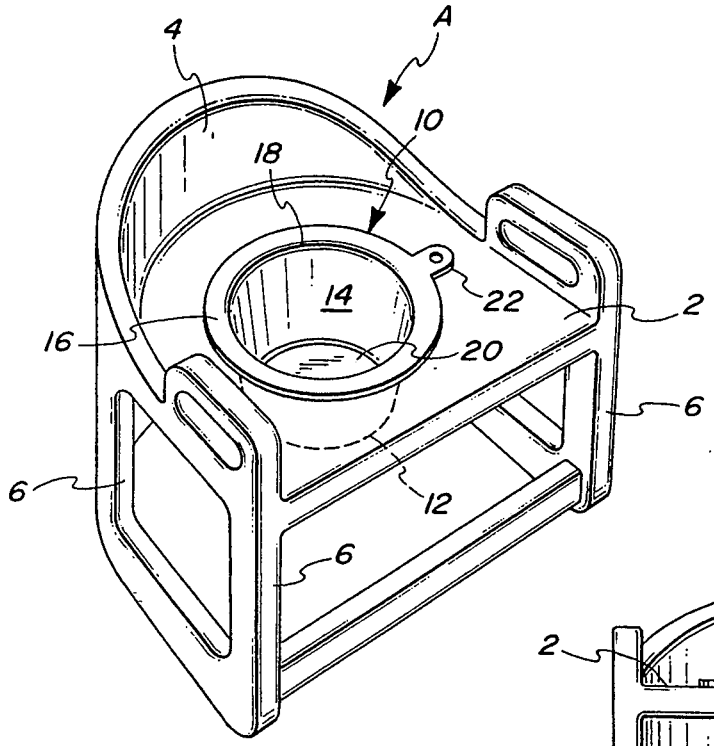
FIG. 1 is a perspective view of the toilet training device according to the present invention prior to use.
Figure 2:
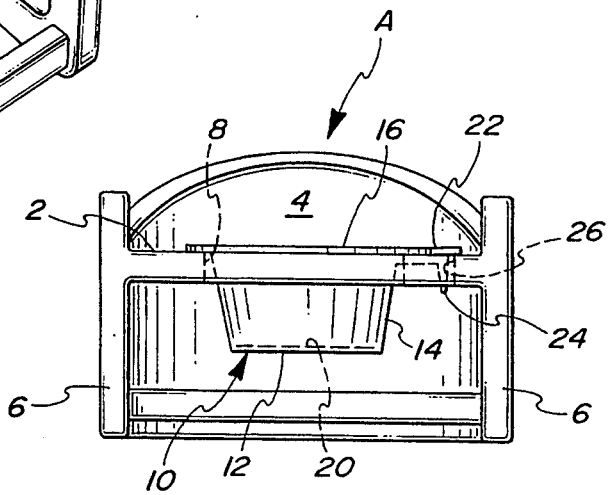
FIG. 2 is a front end view of the device shown in FIG. 1 with the thermally actuated latent image element shown in hidden lines disposed within the receptacle means.

Turning now to FIGS. 1 and 2, a child's "potty" or toilet training chair A is generally shown comprising a horizontal seat 2, backrest 4 and support legs 6. The seat 2 of the chair A includes an opening 8 configured to receive and support a receptacle 10. If desired, the receptacle 10 may be integral with chair A.

Receptacle 10 generally comprises a bottom 12, side portions 14 and flange 16 the inner perimeter of which defines an open top 18 of the receptacle 10. It is within the scope of the present invention to provide other types of receptacle designs. The essential feature is that it retain the urine and allow the latent image to be fully viewed. A thermally actuated latent image element 20 is shown disposed within the receptacle 10 on the bottom portion 12. As can be appreciated, element 20 may be disposed within receptacle 20 at a portion other than bottom 12.

An alignment means 22 comprising a lateral tab extends outwardly from the flange 16. A peg or projection 24 extends downwardly from the alignment means 22. Peg 24 interfits recess 26 within the chair seat surface 2 thereby aligning the receptacle 10 and preventing the receptacle 10 from axially rotation while positioned in chair A. As is readily apparent, other alignment and locking means are contemplated within the scope of the present invention. The main requirement within the meaning of the present invention is that such locking means be readily engageable, disengageable and prevent unnecessary movement of the receptacle.

Thermally actuated latent image element 20 comprises a temperature-sensitive sheet or film preferably containing thermochromic liquid crystals (TLC) although other such compounds are within the scope of the invention. TLC's react to changes in temperature by changing color. A variety of chemical compounds are now used in the formulation of thermochromic liquid crystals. Generally speaking, TLC's show color by selectively reflecting incident light. The color changes are reversible upon cooling. If compounds other than TLC's are used, they should yield similar temperature-sensitive properties.

TLC's can essentially be divided into two distinct types according to their chemical structure. Cholesteric formulations which are comprised entirely of cholesterol and other sterol derived chemicals and chiral neumatic formulations comprised entirely of non-sterol based chemicals. In addition, some TLC formulations contain a combination at both cholesteric and chiral neumatic components.

As noted above, TLC's show color by selectively reflecting incident white light. Temperature-sensitive mixtures in thin films reflect bright, almost pure colors, turning from colorless (black, against a black background) to red at a given temperature and as the temperature is increased, pass through the other colors of the visible spectrum in sequence (orange, yellow, green, blue, violet) before turning colorless at higher temperatures still.

TLC's can be produced as temperature-sensitive inks optimized for application into print using high speed screen-printing techniques. The majority of thermochromic laminated substrates employing TLC's contain a thin film of liquid crystal sandwiched between a transparent polymer sheet substrate and a black absorbing background. For example, a coating ink containing microencapsulated TLC's is silk screen printed onto a supporting substrate. A black ink is then applied on top of the dry TLC coating and color change effects are viewed from the reverse (uncoated) side of the sheet. Thus, a design can be printed onto a suitable substrate using TLC ink which will remain a latent image until the ink has been subjected to a temperature sufficient to actuate the thermochromic crystals causing the latent image becomes visible.

In the present invention, a substrate sheet of 5 mil clear polyester such as Mylar® or Melinex® is first selected. The sheets are printed on one side, first with the microencapsulated TLC coating, then with a black backing ink. The color change may then be viewed through the clear, uncoated side of the sheet. The substrate sheet may be provided with adhesive-backing such as pressure-sensitive adhesives to allow the latent image element 20 to be secured to the receptacle 10. In addition, the substrate can be treated to provide UV stability and water-resistance.

TLC's within the scope of the present invention are those which render good appearance and clear bright color-change properties. Dyes may be added to the mixture to augment the colors. Over-printing two or more different TLC coatings will produce a multi-color play indicia which is also within the scope of the present invention.

Representative temperature sensitive liquid crystal compositions within the scope of the present invention are described in U.S. Pat. Nos. 3,898,354; 3,861,213; and 3,965,742 each of which issued to Parker and all of which are incorporated herein by reference. Preferred TLC printed substrates suitable for use as the thermally activated latent image element 20 are manufactured by Hallcrest of Glenview, Ill.

The working temperature range for TLC mixtures currently available is approximately −220° F. (−30° C.) to 239° F. (115° C.). The thermochromic liquid crystals within the scope of the present invention however, are used to create temperature-sensitive inks and coatings which become visible at a temperature range matching that of a child's urine. Generally speaking, this is about 96° F. however the exact temperature can fluctuate either above or below 96° F. depending upon the particular child. The main requirement is that the image be activated by the heat generated from the child's urine.

The temperature-sensitive ink or coating is applied onto a substrate preferably via silk screen printing or other printing to create a latent image readily recognizable by the child. Such indicia includes animals, fish, birds, or fictional characters readily apparent to the child by shape. The indicia can be printed on the substrate in of arrangements so long as it is easily recognized by the child. The main feature of the image is that the selected picture or indicia be one which is pleasant to the child and encourages him or her to want to use the training device. The present invention is not limited to any particular indicia or figure. It is preferred that the indicia have a good, clear appearance with bright colors that attract the child's attention.

Figure 3:
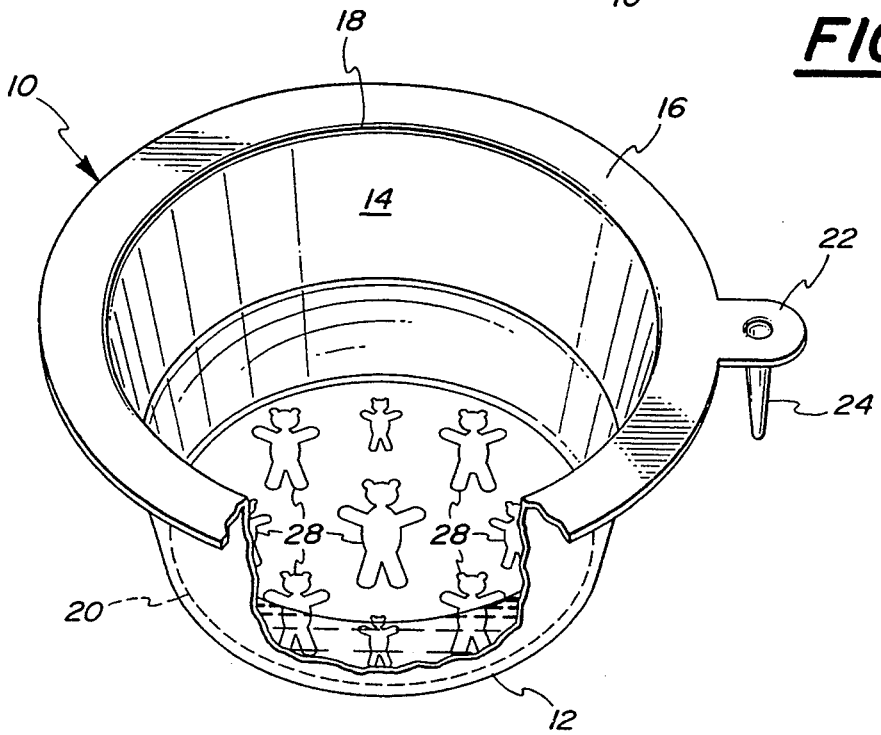
FIG. 3 is an enlarged perspective of the receptacle means shown in FIGS. 1 and 2 with portions broken away to illustrate urine received within the receptacle and the appearance of the latent images on the latent image element with portions thereof shown by hidden lines.

Turning now to FIG. 3, the receptacle 10 of FIGS. 1 and 2 is shown in greater detail containing urine after use of the device by a child. As is readily apparent, numerous indicia 28 appear on the substrate 20 as the latent image becomes visible due to the color-change properties of the ink. The substrate 20 is actuated by the heat radiating from the urine as it fills the receptacle 10 and contacts the thermally actuated latent image element 20. The child, upon recognizing the indicia 28 is thereby encouraged to use the device during toilet training and will associate pleasant thoughts of the device in the future.

After use by the child, the receptacle 10 can be lifted out of the chair seat 2 so that the collected urine may be disposed of in a known manner. Once the urine has been removed from the receptacle 10, the heat which had activated the latent image element 20 is no longer present and the indicia 28 will fade from view once the thermochromic properties of the ink reverses. More specifically, cooling of the image element 20 results in a color change sequence which is reversed back to the non-differentiated background color of the image element 20. If desired, the image can be non-reversible. In that embodiment, the element 20 is removed after use and a new element is placed within the receptacle prior to the next training session.

Figure 4:
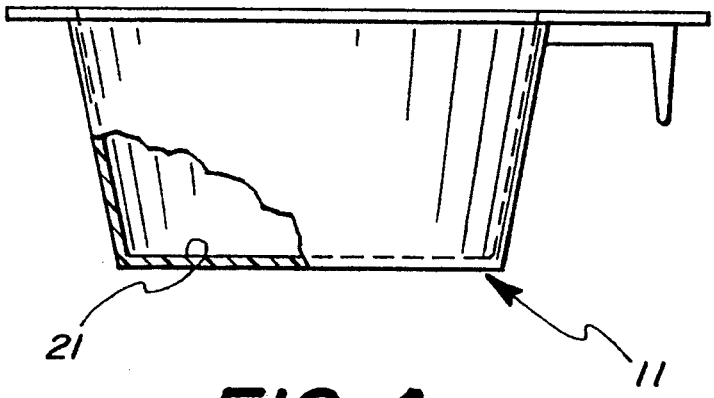
FIG. 4 is a front end view, partially broken away, of the receptacle means having the image substrate integral with the receptacle means bottom.

A wide range of substrates containing the thermally actuated latent image 20 are within the scope of the present invention and such substrates may be either rigid or flexible or have various thicknesses. As shown in FIG. 4, it is also possible to cast a substrate 21 into the receptacle 11 if so desired. Further, the thermally actuated latent image element 20 can be positioned anywhere within the interior of the receptacle 10. For example, it may initially be positioned along the side portions 14 and as the child improves in training can be repositioned to the bottom 12 of the receptacle 10.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A reusable image generating toilet training device for children comprising:

a) a receptacle for receiving urine from a child;

b) a chair member having an opening therein for receiving and supporting said receptacle;

c) said receptacle having a bottom, sides and an open top;

d) a reversible image generating element having a first latent image phase operable at a first predetermined temperature and a second exposed image phase operable at a second predetermined temperature such that re-exposure to the first predetermined temperature will result in a change back to said first latent image phase; and e) said image generating element is positioned on said receptacle bottom and viewable by the child from said open top so that when the child urinates into the receptacle, the urine will collect on the receptacle bottom and cover the reversible image element generating said second exposed image phase for viewing by the child.

2. A toilet training device as in claim 1 and wherein:

a) said second exposed image phase is thermally actuated by radiant heat from the urine.

3. A toilet training device as in claim 1 and wherein:

a) said image element comprising a planar sheet.

4. A toilet training device as in claim 1 and wherein:

a) said image element is integral with said receptacle means.

5. A toilet training device as in claim 1 and wherein:

a) said reversible image generating element including an image printed on said element using thermochromic coatings actuatable by heat released from the urine upon contact with the element.

6. A toilet training device as in claim 5 and wherein:

a) said image comprising indicia recognizable by the user.

7. A toilet training device as in claim 1 and wherein:

a) said second predetermined temperature is the temperature range of the normal and ambient body temperature range for a child.

8. A toilet training device as in claim 1 and wherein:

a) said second predetermined temperature is about 96° F.

9. A toilet training device as in claim 1 and wherein:

a) said receptacle including locking means to secure said receptacle to the seat member during use.

* * * * *